US006508069B2

(12) United States Patent
Sibilia

(10) Patent No.: US 6,508,069 B2
(45) Date of Patent: Jan. 21, 2003

(54) TEMPERATURE CONTROLLED GRAVITY FEED FOUNTAIN SOLUTION SUPPLY APPARATUS

(76) Inventor: Peter M. Sibilia, 552 Carmel Hill Rd. North, Bethlehem, CT (US) 06751

( * ) Notice: Subject to any disclaimer, the term of this patent is extended or adjusted under 35 U.S.C. 154(b) by 160 days.

(21) Appl. No.: 09/773,820

(22) Filed: Feb. 2, 2001

(65) Prior Publication Data

US 2001/0045169 A1 Nov. 29, 2001

Related U.S. Application Data

(60) Provisional application No. 60/185,697, filed on Feb. 29, 2000.

(51) Int. Cl.[7] ..... F25D 17/02; F25B 1/00

(52) U.S. Cl. ..... 62/201; 62/435

(58) Field of Search ..... 62/201, 238.6, 62/331, 435; 165/140; 101/147, 487

(56) References Cited

U.S. PATENT DOCUMENTS 4,146,474 A 3/1979 Kagatani
4,384,523 A * 5/1983 Ryan ..... 101/210
5,370,046 A 12/1994 Spiegel et al.
5,622,620 A 4/1997 Meenan et al.
5,720,221 A 2/1998 Harig et al.
5,749,295 A 5/1998 Kurz
5,974,817 A 11/1999 Prummer
6,324,974 B1 * 12/2001 Pomeroy et al. ..... 101/147

* cited by examiner

*Primary Examiner*—Denise L. Esquivel
*Assistant Examiner*—Melvin Jones
(74) *Attorney, Agent, or Firm*—Richard C. Litman

(57) ABSTRACT

A temperature controlled gravity feed fountain solution supply apparatus for a printing unit of a printing press. The invention helps to maintain a consistent, cool temperature within the fountain solution pan of a gravity feed fluid supply apparatus. The apparatus includes an insulated, air-tight fountain solution supply tank connected to a lower fountain solution pan by a vertical insulated supply tube. The tank has cooling coils arranged in M-shaped layers, each of the layers being supported by a perforated, heat-conducting cooling plate. The pan has a supply pool that communicates with an elongated dispersement tube having openings which serve to circulate fountain solution about three cooling fins connected to, and extending the length of the dispersement tube. Alternatively, the solution pan has a separate cooling coil and cooling control.

20 Claims, 12 Drawing Sheets

TEMPERATURE CONTROLLED GRAVITY FEED FOUNTAIN SOLUTION SUPPLY APPARATUS

CROSS-REFERENCE TO RELATED APPLICATION

This application claims the benefit of U.S. Provisional Patent Application Ser. No. 60/185,697, filed Feb. 29, 2000.

BACKGROUND OF THE INVENTION

1. Field of the Invention

The present invention relates generally to printing press reservoirs and, more specifically, to a gravity feed fountain solution supply apparatus for supplying a temperature controlled fountain solution to the fountain solution pan of a printing press.

2. Description of the Related Art

Fountain solutions were historically gravity fed from the fountain solution tank to the fountain solution pan of a printing press. Gravity fed systems have the advantage of design simplicity and near zero waste of fountain solution. As the art of lithography developed, it was discovered that controlling the temperature of the fountain solution led to greater and more consistent quality of print. In order to maintain consistent temperatures within the fountain solution, refrigerated fountain solution recirculating systems were developed. These recirculating systems also incorporated an apparatus for adding an accurate amount of alcohol to the fountain solution, to use as a wetting agent, i.e., to reduce the surface tension of the fountain solution. This development worked well for years mainly because the alcohol helps to mask or to reduce the effects of the contaminants. However, it was discovered that the alcohol in the fountain solution poses a serious health risk to the operators of printing presses. Therefore, elimination of alcohol as a wetting agent had become a priority in the printing industry, and mandatory in some states. As a replacement, wetting agents (i.e., to replace alcohol) were developed, the effects of the contaminants became a disproportionate problem. With recirculating systems, contamination to the fountain solution accrues while the solution circulates and recirculates through the system. Specifically, plasticizers from the rollers, and paper particles and spray powder from the sheets migrate into the fountain solution. Thus, the fountain solution typically has to be changed every few days, which, can be an expensive waste disposal problem. Another problem with recirculating systems is excessive use of water and other resources, and loss of time, that is, approximately two hours down time every few days while the contaminated fountain solution is being changed. Again, the advantage of the recirculating system is that it is easier to cool because the fluid is circulating. Thus, there is a need for a fountain solution supply system which solves the above problems. More precisely, there has been a need for a temperature controlled, gravity feed fountain solution supply system which has an efficient method for maintaining a cool fountain solution temperature, particularly with the larger offset presses that produce substantial heat. The related art discussed below is representative of developments prior to my invention.

U.S. Pat. No. 4,146,474 issued to Kagatani on Mar. 27, 1979 describes a method and apparatus for controlling dampening water in printing machines. Kagatani is a recirculating unit rather than a gravity feed unit. Kagatani therefore does not teach the present invention as claimed.

U.S. Pat. No. 5,370,046 issued to Spiegel et al. on Dec. 6, 1994 describes an inking unit for printing presses. The device monitors the temperature of rollers by putting a temperature probe in the ink train. This invention pertains to the temperature of ink wells and the ink train, but does not control the temperature in the fountain solution pan. Spiegel et al. therefore do not teach the present invention as claimed.

U.S. Pat. No. 5,720,221 issued to Harig et al. on Feb. 24, 1998 describes an assembly for controlling the temperature of a fountain solution. However, Harig et al. is a recirculating, rather than a gravity feed system and therefore, does not teach the present invention as claimed.

U.S. Pat. No. 5,974,817 issued to Prummer, M. on Nov. 2, 1999 describes an assembly for controlling the temperature of a fountain fluid by pumping it through a printing roller via a heat exchanger, or radiator, located between a recirculating system and the fountain solution pan. Prummer does not teach the present invention as claimed.

Other printing press fountain solution supply systems of general interest are shown in U.S. Pat. No. 5,622,620 issued to Meenan et al. on Apr. 22, 1997, and U.S. Pat. No. 5,749,295, issued to Kurz, H. on May 12, 1998. None of the above inventions and patents, taken either singly or in combination, is seen to describe the instant invention as claimed.

SUMMARY OF THE INVENTION

The present invention is used to gravity feed a continuous supply of cooled fountain solution for consumption by the printing unit of a commercial printing press. The apparatus uses a refrigerant supplied from a refrigeration unit in one embodiment and chilled water supplied from a chiller in another embodiment. The apparatus includes an insulated, airtight fountain solution supply tank connected to a fountain solution pan via a gravity fed supply tube.

In a gravity feed apparatus, a printing unit continuously consumes fountain solution as the pan roller rotates and consumes fountain solution. The pan is resupplied by operating a valve allowing solution to flow from the tank. The present tank is an insulated, air tight container. An essential feature of the tank is its cooling coils arranged in M-shaped layers. Each of the layers is supported by a perforated, heat-conducting cooling plate for efficient movement of the cooled fountain solution through the tank. A tank thermostat is connected to the refrigeration unit, and to first temperature probe to monitor the tank fountain solution temperature.

An insulated supply tube connects the tank to a fountain solution pan supply pool which is also part of the invention. The supply pool serves as a temporary receptacle for fountain solution traveling from the tank via the supply tube. The pan's supply pool empties into an elongated dispersement tube that has a plurality of openings that increase in diameter from the near wall to the far wall of the pan. The tube also includes at least three cooling fins extending the length of the dispersement tube.

As the pan roller spins on its axis, fountain solution is consumed from the pan, and thereby drawn by gravity from the tank longitudinally through the dispersement tube and through its openings. From there, the fountain solution circulates around the cooling fins which exchange heat with the dispersement tube and keep the solution in the pan a constant cool temperature.

In another embodiment, cooling coils are also present in the fountain solution pan and there is a separate temperature control for maintaining a desired pan temperature by regulating the flow of coolant to the pan. The pan has a dispersement tube, as above, but, each opening opens into a separate, compartment which is open at both the front, near the pan wall and dispersement tube, and the back, directing the solution to the cooling coil and then to the pan roller.

Accordingly, it is a principal object of the invention to minimize waste solution in a printing press apparatus while maintaining optimally cool temperatures in the fountain solution tank and the fountain solution pan.

It is another object of the invention to minimize contamination in the fountain solution pan.

It is a further object of the invention to minimize the loss of heat energy in a gravity fed fountain solution pan, and to reduce the down time of the printing apparatus.

It is yet another object of the invention to minimize the use of water and other resources in the printing process.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
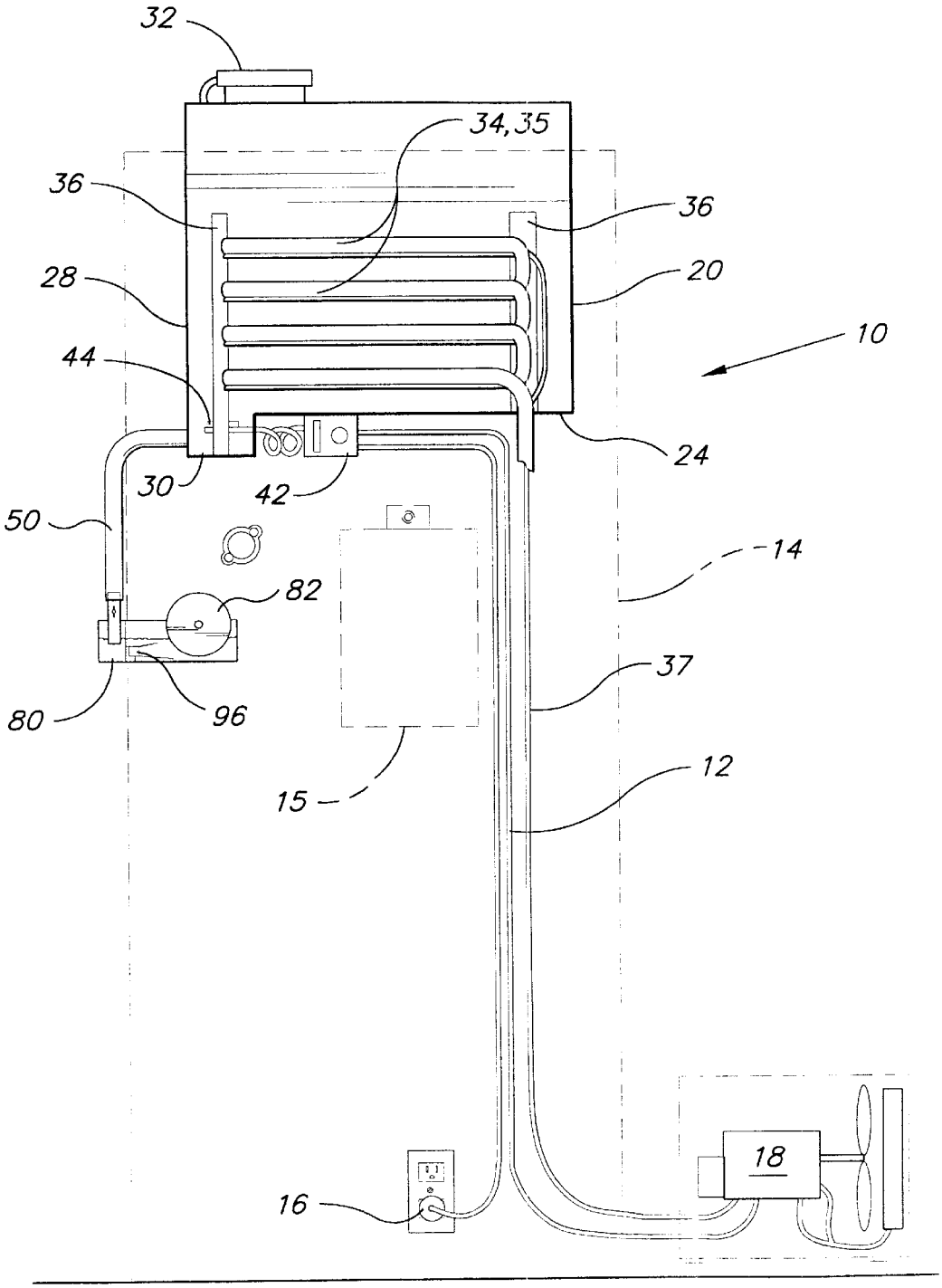
FIG. 1 is an environmental perspective view of a temperature controlled gravity feed fountain solution supply system according to the present invention.

The present invention, as best shown in FIG. 1, is a temperature controlled gravity feed fountain solution supply apparatus 10. Apparatus 10 is used to feed a continuous supply of cooled fountain solution 22 to the printing unit 14 of a commercial printing press. In its operating environment, apparatus 10 has energy supplied preferably by a 110-volt power source 16, and has a refrigerant supplied from refrigeration unit 18 through coolant line 12. Also shown in FIG. 1, incidental to the invention is a circumferential register unit 15.

Apparatus 10 essentially comprises an insulated, airtight fountain solution supply tank 20 connected, via a gravity feed supply tube 50, to a fountain solution pan 80. Pan 80 is shown in greater detail in FIGS. 3A–3C. As shown in FIG. 3C, printing unit 14 continuously consumes fountain solution 22 due to the rotation of a fountain solution pan roller 82 disposed within pan 80.

Figure 2A:
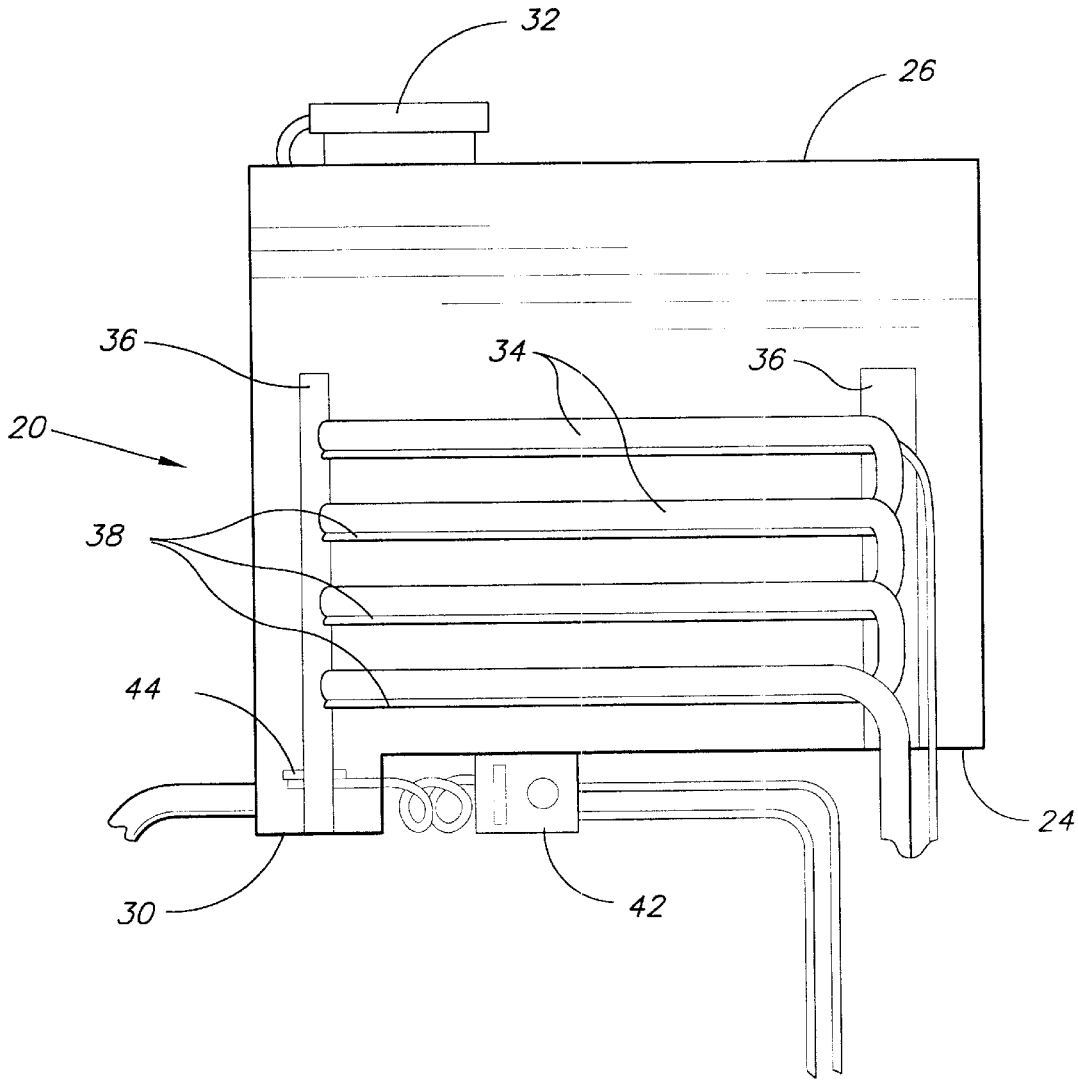
FIG. 2A is an elevation view of the fountain solution tank, showing layers of cooling coils, coupled to steel cooling plates.

Referring now to FIG. 2A, tank 20 is an insulated, air tight, preferably stainless steel, preferably four to five gallon container. It is insulated(not shown) to maintain thermal efficiency and to prevent sweating of tank 20. Tank 20 has an inside bottom surface 24, a top surface 26, a plurality of sides 28, and a fountain solution outlet 30. A radiator style cap 32 is disposed on top surface 26 to fill tank 20 with fountain solution 22 when opened, and to maintain air tightness and measured gravity feed of the fountain solution when closed. Tank 20 may include plexiglass sight glasses (not shown) on at least one of sides 28 to enable visual monitoring of the level of fountain solution 22 within tank 20.

Figure 2B:
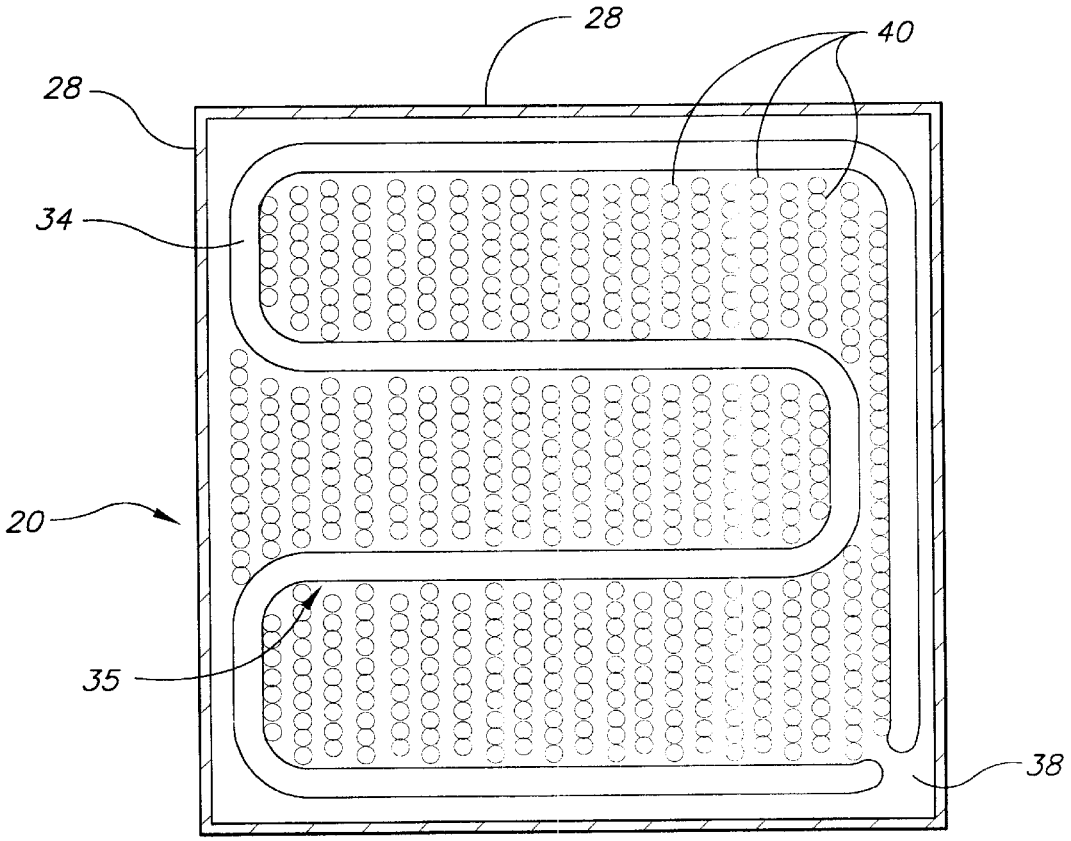
FIG. 2B is a plan view of the fountain solution tank, showing one layer of cooling coils on a perforated steel cooling plate.

Referring to FIGS. 1, 2A, and 2B, tank 20 also contains a cooling apparatus having a plurality of cooling coils 34 preferably made from stainless steel. Coils 34 are arranged in layers 35. As shown in FIG. 2B, coils 34 are supported upon bottom surface 24 via cooling plate supports 36. Preferably, each of the coils 34 are M-shaped. Supporting each of the layers 35 of the coils 34 is a non corrosive heat-conducting cooling plate 38, preferably made from stainless steel, attached to the base of each coil 34. Preferably, plate 38 is perforated with a multitude of cooling plate holes 40 acting as baffles for efficient movement of the cooled fountain solution through tank 20. The diameter of each of holes 40 is about three to eight millimeters but preferably about five to six millimeters; any smaller and the solution won't flow adequately and efficiently through holes 40; any larger, and the plate will not cool fountain solution 22 as efficiently or as optimally as is required. Also see FIG. 4B, below for a depiction of the supply tank floor 124 corresponding to tank floor 42.

Cooling plate supports 36 are preferably made from stainless steel rods that connect bottom surface 24 of tank 20 to two opposite side edges of each of cooling plates 38.

A thermostat 42, preferably set to a temperature in the range of 45 to 70 degrees Fahrenheit, according to taste and printing considerations, is connected to refrigeration unit 18 by refrigerant supply line 12, and to first temperature probe 44. Probe 44 extends into the interior of tank 20 to thermostat 42, in order to monitor the temperature of the fountain solution within tank 20. Refrigerant supply line 12 is connected to coils 34, which in turn are connected to refrigerant return line 37.

An insulated supply tube 50 connects tank 20 to fountain solution pan 80, and acts as a gravity feed supply route for fountain solution therebetween. Tube 50 comprises an upper tube 52, preferably made from stainless steel, and extending from outlet 30, near first temperature probe 44, to a flexible insulated middle tube 54, which is in turn connected to stainless steel lower tube 56. Supply tube 50 is preferably a one-piece stainless steel tube having exterior insulation, but as described above, it may also be formed from three connecting discreet segments.

Figure 3A:
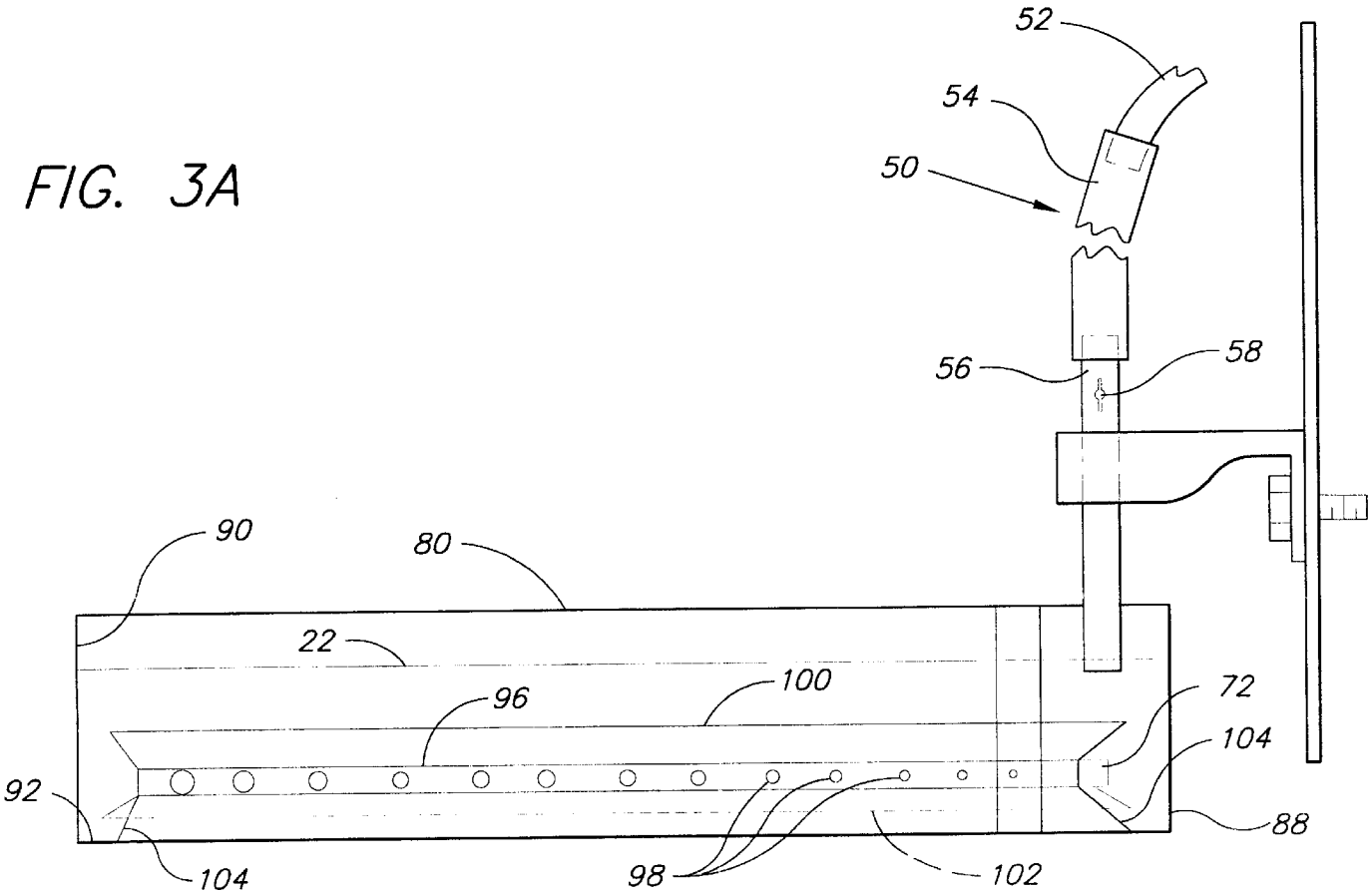
FIG. 3A is a frontal view of the temperature controlled fountain solution pan, looking directly into the dispersement tube openings, and showing the three cooling fins.
Figure 3B:
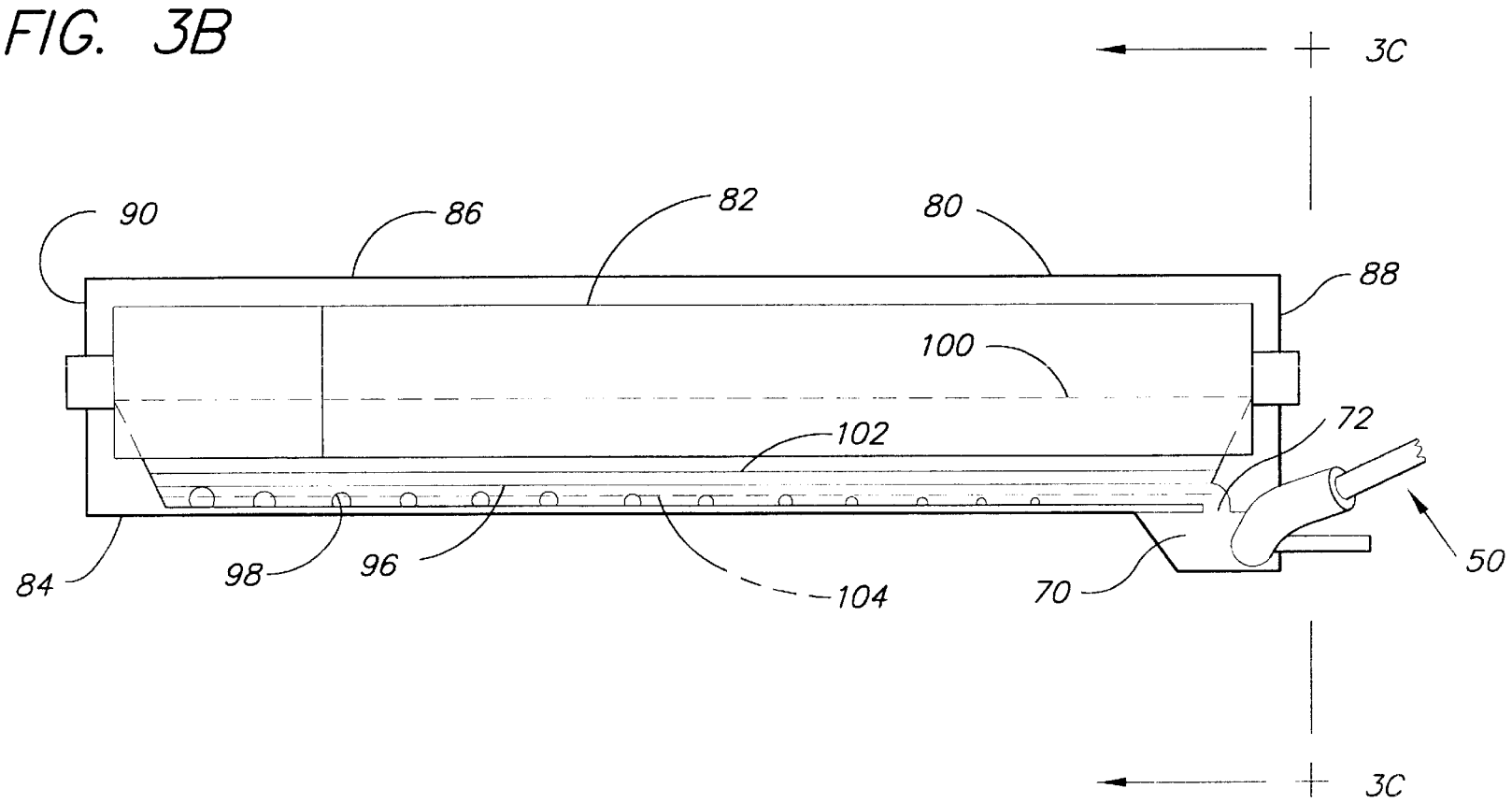
FIG. 3B is a top view of the temperature controlled fountain solution pan, showing the three cooling fins.
Figure 3C:
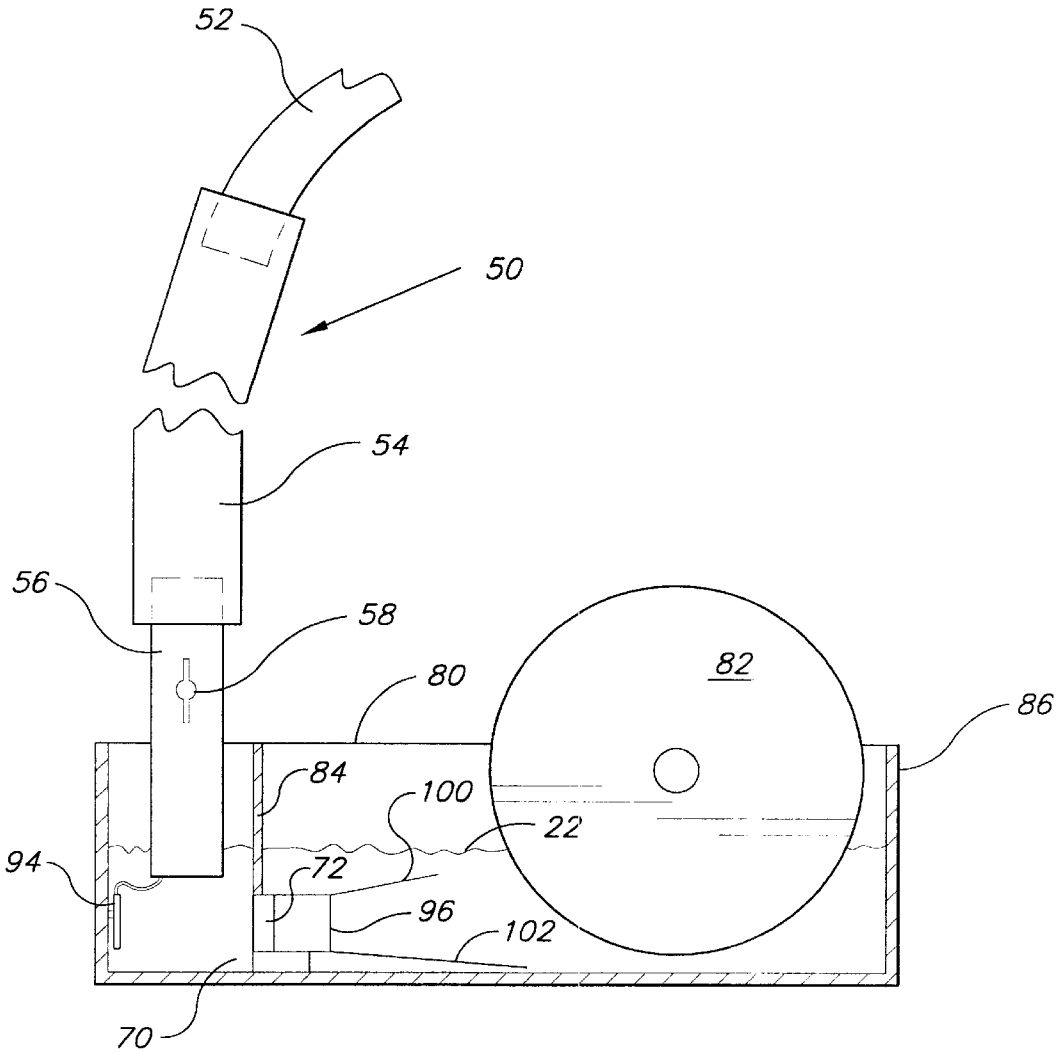
FIG. 3C is an end view of the pan shown in FIG. 3B.

Referring to FIGS. 3A, 3B, and 3C, lower tube 56 of supply tube 50 extends into supply pool 70 of fountain solution pan 80. A shutoff valve 58, preferably a rotating ball-type valve, is disposed within lower tube 56 of supply tube 50. Valve 58 is turned off when tank 20 is filled with fountain solution, and is opened in order to replenish fountain solution that is consumed by al roller 82 while printing unit 14 is in operation.

Fountain solution pan 80, disposed below tank 20, has a housing preferably made from insulated stainless steel. The housing of pan 80 has a substantially rectangular, box-shaped configuration. Pan 80 includes an elongated left wall 84, an elongated right wall 86 opposite left wall 84, a short near wall 88, a short far wall 90 opposite near wall 88, and a lowest surface 92 connecting each foregoing wall of pan 80.

Supply pool 70 of pan 80, into which supply tube 50 empties, is disposed within a corner of pan 80. Preferably pool 70 is disposed proximate the intersection of left wall 84 and near wall 88. There may be a second temperature probe 94 in supply pool 70. The purpose of supply pool 70 is to serve as a temporary receptacle for fountain solution traveling from supply tube 50 to elongated dispersement tube 96.

The end view (FIG. 3C) of dispersement tube 96 is rectilinear in shape and extends substantially the length of pan 80, as further shown in FIGS. 3A and 3B. Dispersement tube 96 is connected to and supported by left wall 84, and is proximate to, but not connected to, lowest surface 92. Dispersement tube 96 includes a dispersement tube inlet 72 communicating with supply pool 70. Dispersement tube 96 has a plurality of dispersement tube openings 98 facing left wall 84 along the longitudinal axis of dispersement tube 96. Openings 98 increase in diameter from near wall 88 to far wall 90. There are approximately twenty openings 98, ranging from about one and one half to three millimeters in diameter.

Tube 96 also includes a plurality of cooling fins extending substantially the length of dispersement tube 96. As best shown in FIG. 3C, there are at least three cooling fins, including a first cooling fin 100, a second cooling fin 102, and a third cooling fin 104. First cooling fin 100 extends from a top right edge of dispersement tube 96 generally toward right wall 86 and angled slightly away from lowest surface 92, at an acute angle from a plane parallel to lowest surface 92. Second cooling fin 102 is preferably wider than fin 100 since fin 102 better complements roller 82. That is, fin 102 extends from a bottom right edge of dispersement tube 96 generally toward right wall 86 and angled slightly toward lowest surface 92, at an acute angle from a plane parallel to lowest surface 92 of pan 80. It is noted that cooling fins 100 and 102 may have perforations formed therethrough so as to increase their surface area and thus their efficiency. Third cooling fin 104 extends from a base of dispersement tube 96 to lowest surface 92, at an angle perpendicular to lowest surface 92. The purpose of fin 104 is to force the fountain solution, as it exits through openings 98, in a clockwise direction around roller 82 so that it achieves maximum contact with cooling fins 100 and 102.

In operation, as roller 82 of a printing unit spins on its axis, fountain solution 22 is consumed from fountain solution pan 80. As this occurs, fountain solution is drawn by gravity from tank 20 through supply tube 50 into said supply pool 70. From pool 70, fountain solution 22 is drawn through dispersement tube inlet 72, and then longitudinally through dispersement tube 96 toward far wall 90. As the fountain solution loses pressure within tube 96, it exits through the increasingly larger dispersement tube openings 98. The fountain solution is then forced, due to the obstructing third fin 104, clockwise around the top of dispersement tube 96, where it flows over and around (and/or through) first cooling fin 100, and around second cooling fin 102. Fins 100, 102, and 104 essentially use dispersement tube 96 as a heat exchange device to maintain a consistent low temperature within the fountain solution, as controlled by thermostat 42, and as measured by first temperature probe 44 and/or second temperature probe 94.

Figure 4:
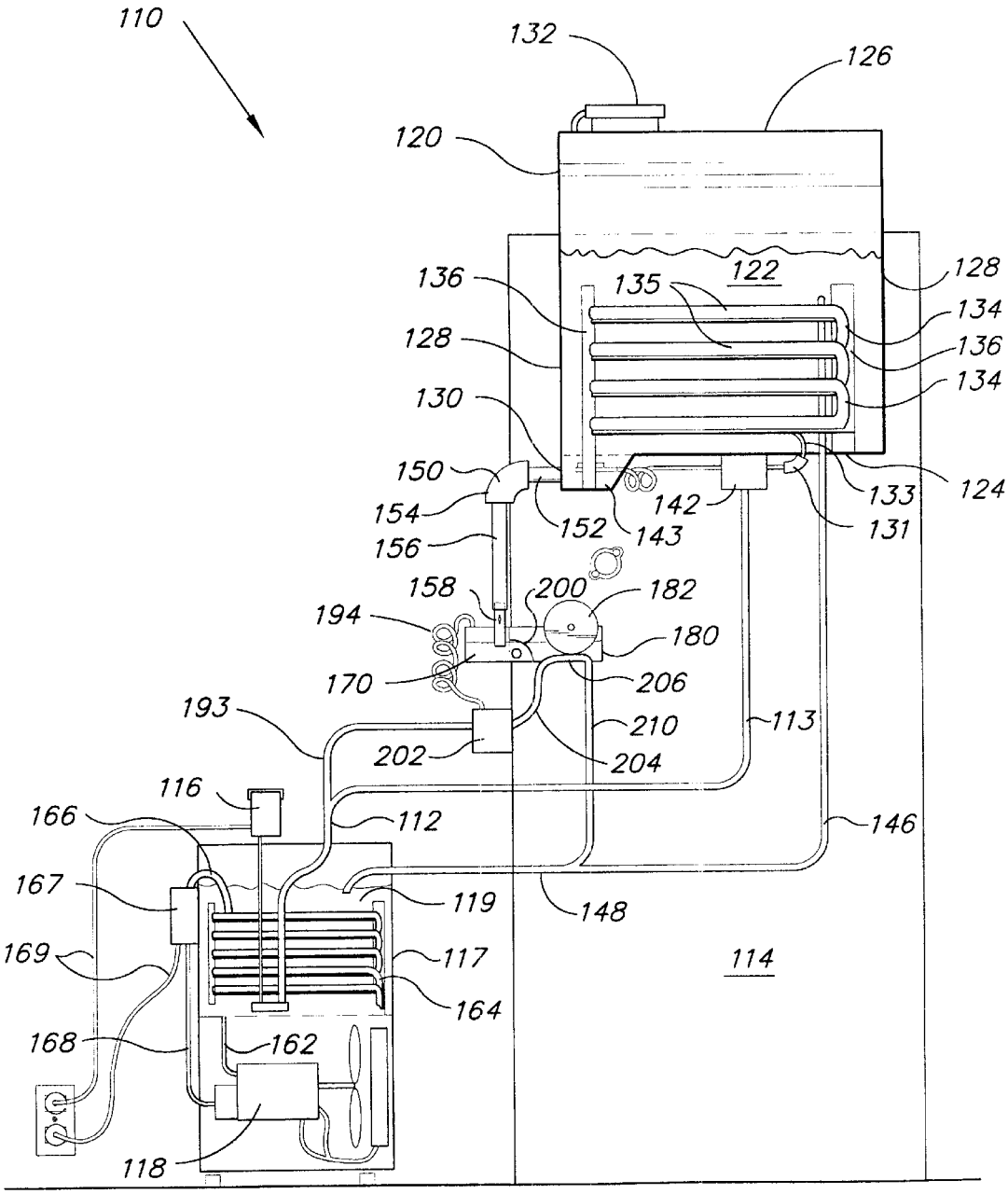
FIG. 4 is an environmental elevation view of another embodiment of the temperature controlled gravity feed fountain solution tank mounted on a printing unit of a printing press, corresponding to that of FIG. 1.

Another embodiment of the present invention, as best shown in FIG. 4, is a temperature controlled gravity feed fountain solution supply apparatus 110. Apparatus 110 is used to feed a continuous supply of cooled fountain solution 122 to the printing unit 114 of a commercial printing press. Apparatus 110 essentially comprises an insulated, airtight, generally rectangular fountain solutions supply tank 120 supplying, via a gravity feed supply tube 150, fountain solution 122 to fountain solution pan 180. Solution supply tank 120 is shown in greater detail in FIGS. 4A and 4B(below). Pan 180 is shown in greater detail in FIGS. 5, 5A, and 5B(below). In its operating environment, apparatus 110 has chilling unit 117 having a refrigerant supplied from refrigeration unit 118. Pump 116 pumps chilled coolant such as water from chilling unit 117 into combined coolant supply line 112. Chilled coolant is then directed to cooling coils 134 of solution tank 120 through coolant supply line 113, and fountain solution pan cooling coil 206 of fountain solution pan 180 (diagrammatically shown) through fountain solution pan coolant supply line 193, respectively. Coolant is then returned to chilling unit 117 by means of tank coolant return line 146 and solution pan coolant return line 210 feeding combined coolant return line 148, respectively. Printing unit 114 continuously consumes fountain solution 122 due to the rotation of a fountain solution pan roller 182 rotating on axles 183(see FIG. 5A) disposed within pan 180.

Figure 4A:
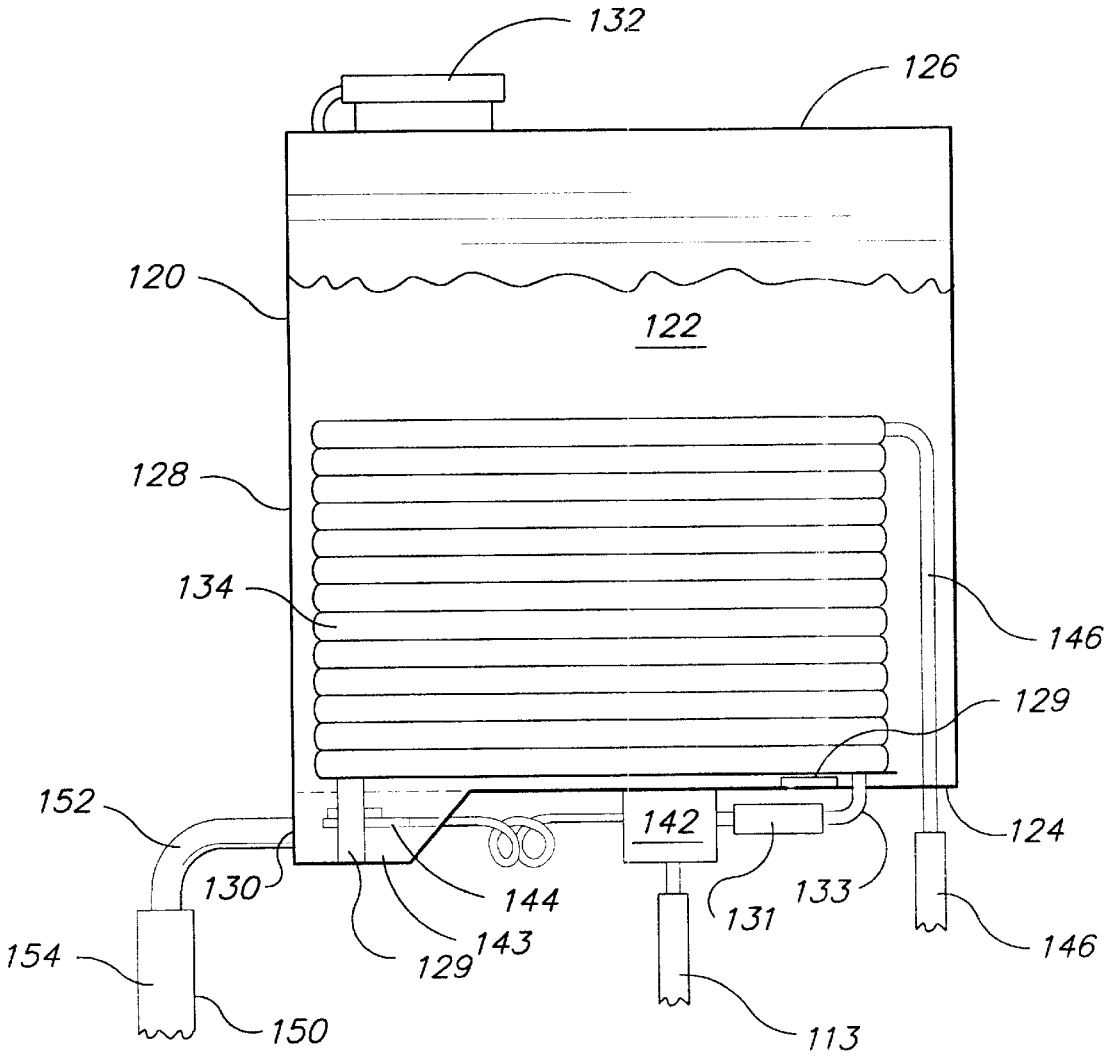
FIG. 4A is an enlarged view of the temperature controlled gravity feed fountain solution tank of FIG. 4 with an alternative cooling coil.

Referring now to FIG. 4A, tank 120 is an insulated, air tight, preferably stainless steel, preferably four to five gallon container. It is insulated (not shown) to maintain thermal efficiency and to prevent sweating of tank 120. Tank 120 has an inside bottom surface 124, a top surface 126, a plurality of sides 128, a lower solution collector 143, and a fountain solution outlet 130. A radiator style cap 132 is disposed on top surface 126 to fill tank 120 with fountain solution 122 when opened, and to maintain air tightness and measured gravity feed of the fountain solution when closed. Tank 120 may include plexiglass sight glasses (not shown) on at least one of sides 128 to enable visual monitoring of the level of fountain solution 122 within tank 120. Tank 120 also contains a cooling apparatus having a plurality of cooling coils 134 preferably made from stainless steel. The bank of coils 134 may be arranged in an "M" shape as in the embodiment of FIGS. 1–3 as shown in FIG. 4, or may be arranged in a rectangle (see FIG. 4A) generally spaced inward of and conforming to the tank sides 128. The coils 134 are supported by supports 129 resting on bottom surface 124. A temperature probe 144, preferably set to a temperature in the range of 45 to 70 degrees Fahrenheit, according to taste and printing considerations, is connected to tank temperature control valve 142. Probe 144 extends into the interior of tank lower solution collector 143 in order to monitor the temperature of the fountain solution within tank 120.

Figure 4B:
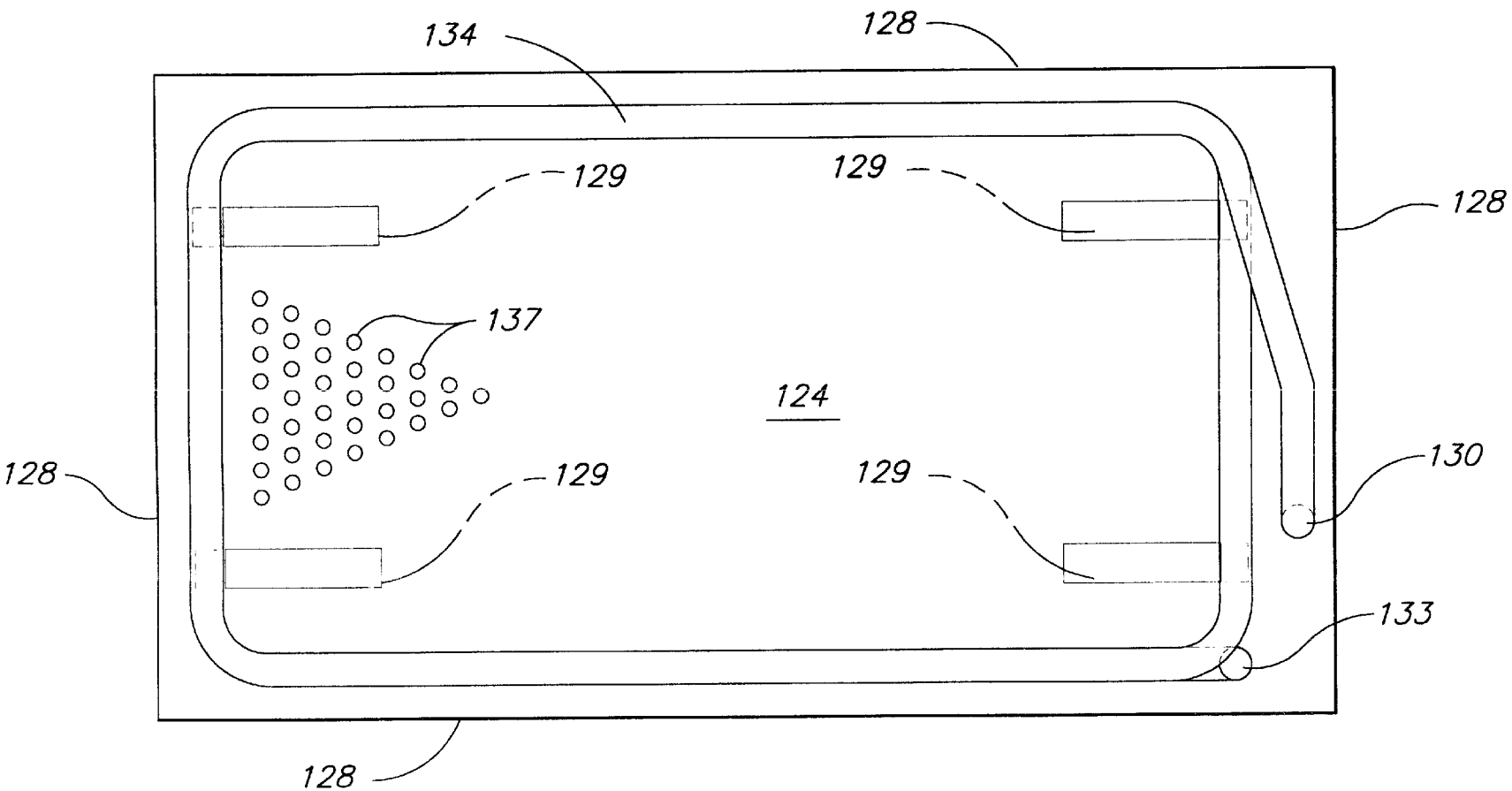
FIG. 4B is a plan view of the base wall of the gravity feed fountain solution tank of FIG. 4A.

Referring to FIGS. 4A and 4B fountain solution tank base 124 features supply tank drain holes 137 acting as a perforated baffle and screen, leading to lower tank solution collector 143 and tank outlet 130 for feeding lower solution collector solution pan supply tube 150. Insulated supply tube 150 connects tank 120 to fountain solution pan 180 (see FIG. 4) and acts as a gravity feed supply route for fountain solution. Tube 150 comprises an upper supply tube 152, preferably made from stainless steel, and extending from outlet 130, near tank temperature probe 144, to a flexible insulated middle tube 154, which is in turn connected to stainless steel lower supply tube 156 (see FIG. 5). Supply tube 150 is preferably a one-piece stainless steel tube having exterior insulation, but as described above, it may also be formed from three connecting discrete segments.

Figure 5:
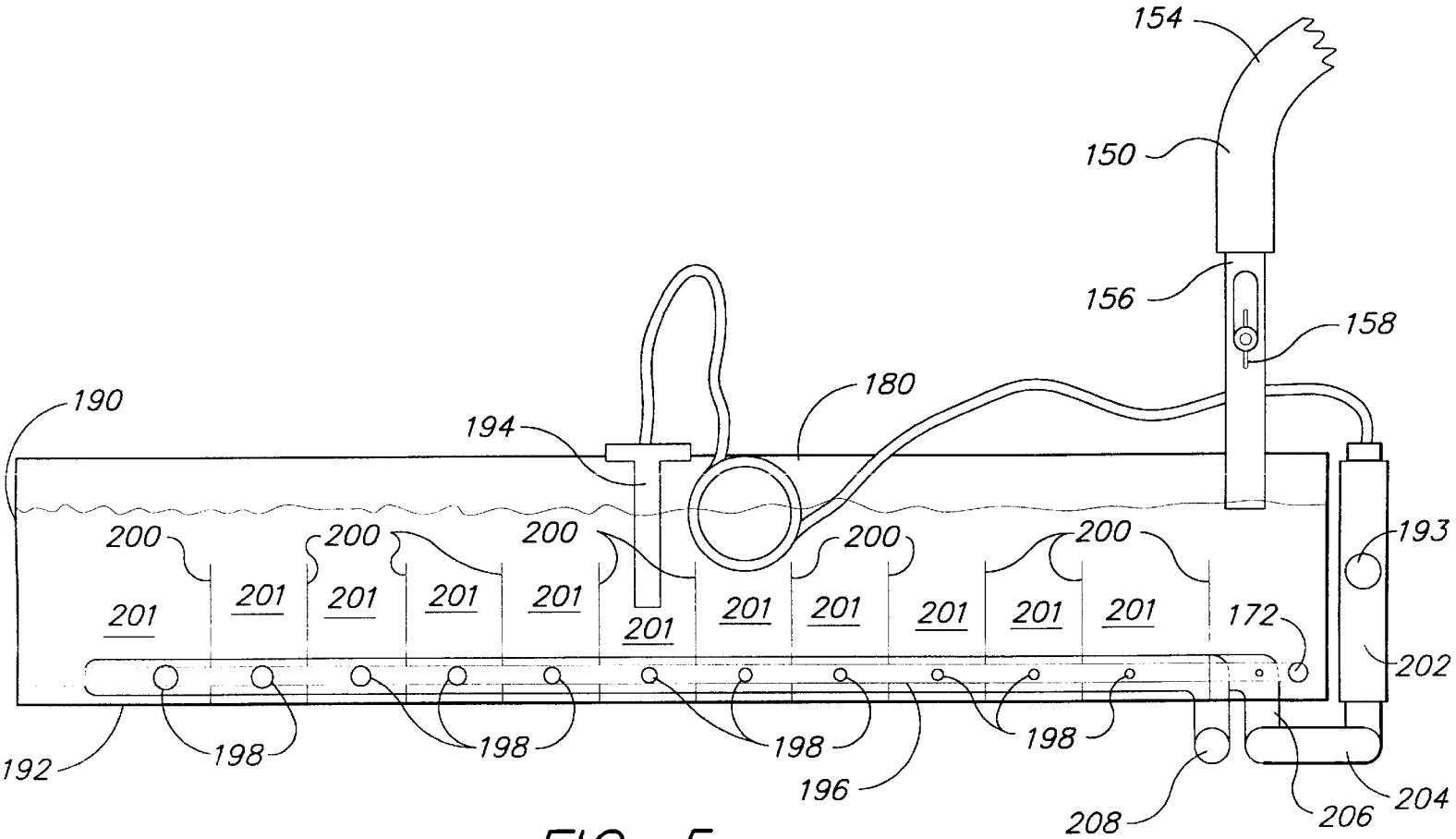
FIG. 5 is a frontal view in elevation of the temperature controlled fountain solution pan of FIG. 4, with the front wall removed, looking directly into the dispersement tube holes, and the feed compartments.
Figure 5A:
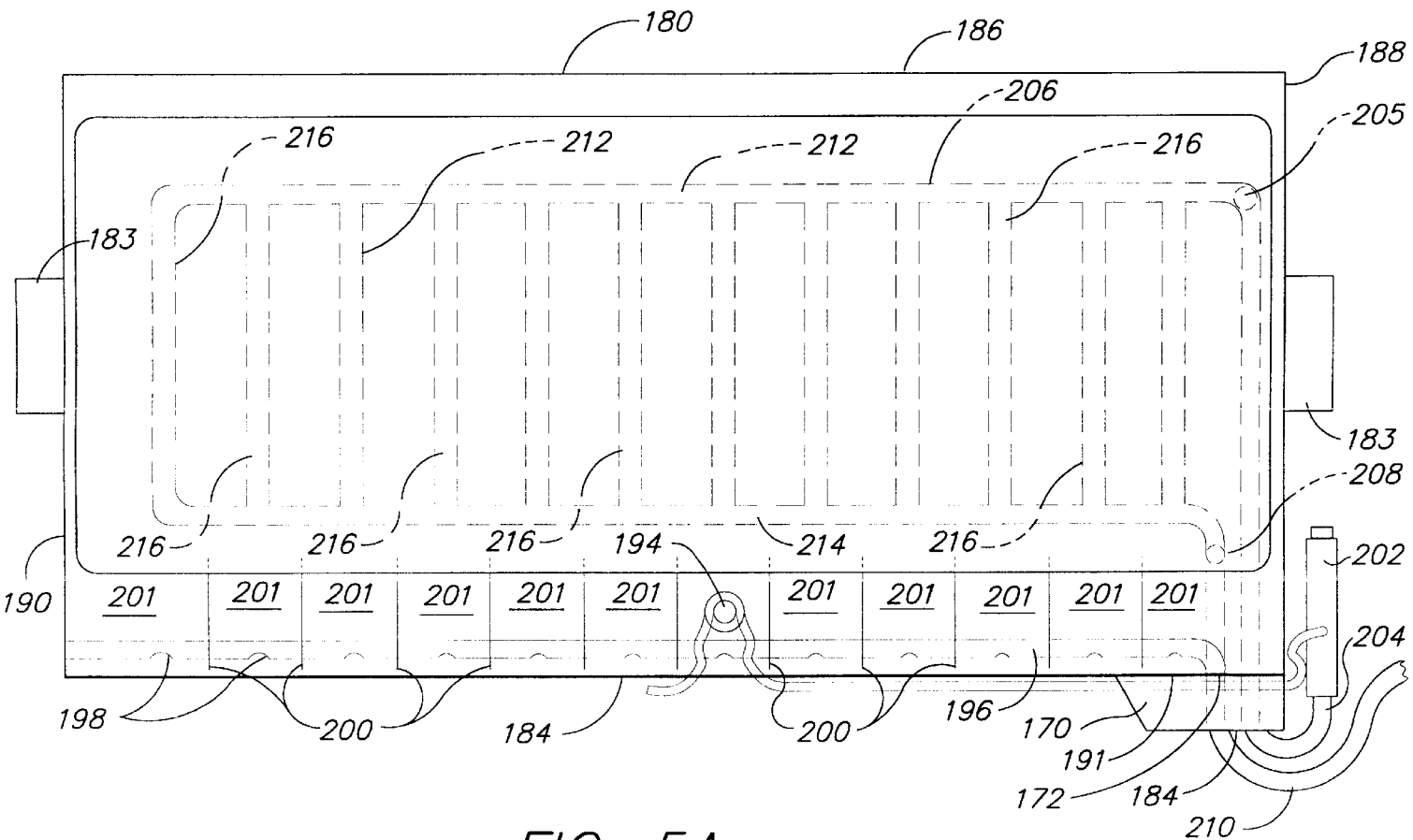
FIG. 5A is a plan view of the temperature controlled fountain solution pan of FIG. 5.

Referring to FIGS. 5 and 5A, lower supply tube 156 of supply tube 150 extends into supply pool 170 of fountain solution pan 180. A supply shutoff valve 158, preferably a rotating ball-type valve, is disposed within lower supply tube 156 of supply tube 150. Valve 158 is turned off when tank 120 is filled with fountain solution, and is opened in order to replenish fountain solution that is consumed by roller 182 while printing unit 114 is in operation.

Referring again to FIG. 4, chilling unit pump 116 of chilling unit 117 pumps a coolant 119 such as chilled water into combined coolant supply line 112 for circulation through supply tank 120 and solution pan 180. Refrigerant unit 118 supplies chilled refrigerant fluid to chilling unit coils 164 by means of feed tube 162. Refrigerant leaves coils 164 through chiller coolant outlet line 166, temperature control valve 167, and refrigerant return line 168 for delivery to refrigerant unit 117. The temperature of coolant 119 is controlled by temperature control valve 167 controlling the flow of refrigerant from refrigerant unit 118, which is responsive to a temperature probe (not shown) within chilling unit 117. Electrical power to pump 116 and control valve 167 are supplied by electrical power lines 169. Combined coolant return line 148 returns coolant fluid from supply tank cooling coils 134 and solution pan coil 206(see FIG. 5) to chilling unit 117 for cooling.

Referring again to FIGS. 5 and 5A, fountain solution pan 180 has a housing preferably made from insulated stainless steel. The housing of pan 180 has a substantially rectangular, box-shaped. configuration. Pan 180 includes an elongated left wall 184, an elongated right wall 186 opposite left wall 184, a short near wall 188, a short far wall 190 opposite near wall 188, and a lowest surface 192 connecting each foregoing wall of pan 180. Supply pool 170 of pan 180, into which supply tube 150 empties, is disposed within a corner of pan 180. Preferably, pool 170 is disposed proximate the intersection of left wall 184 and near wall 188, and is formed by a jutted out portion of left wall 184, by near wall 188, inner supply pool wall 191 and a corresponding portion of lowest surface 192. The purpose of supply pool 170 is to serve as a temporary receptacle for fountain solution traveling from supply tube 150 to elongated dispersement tube 196.

Figure 5B:
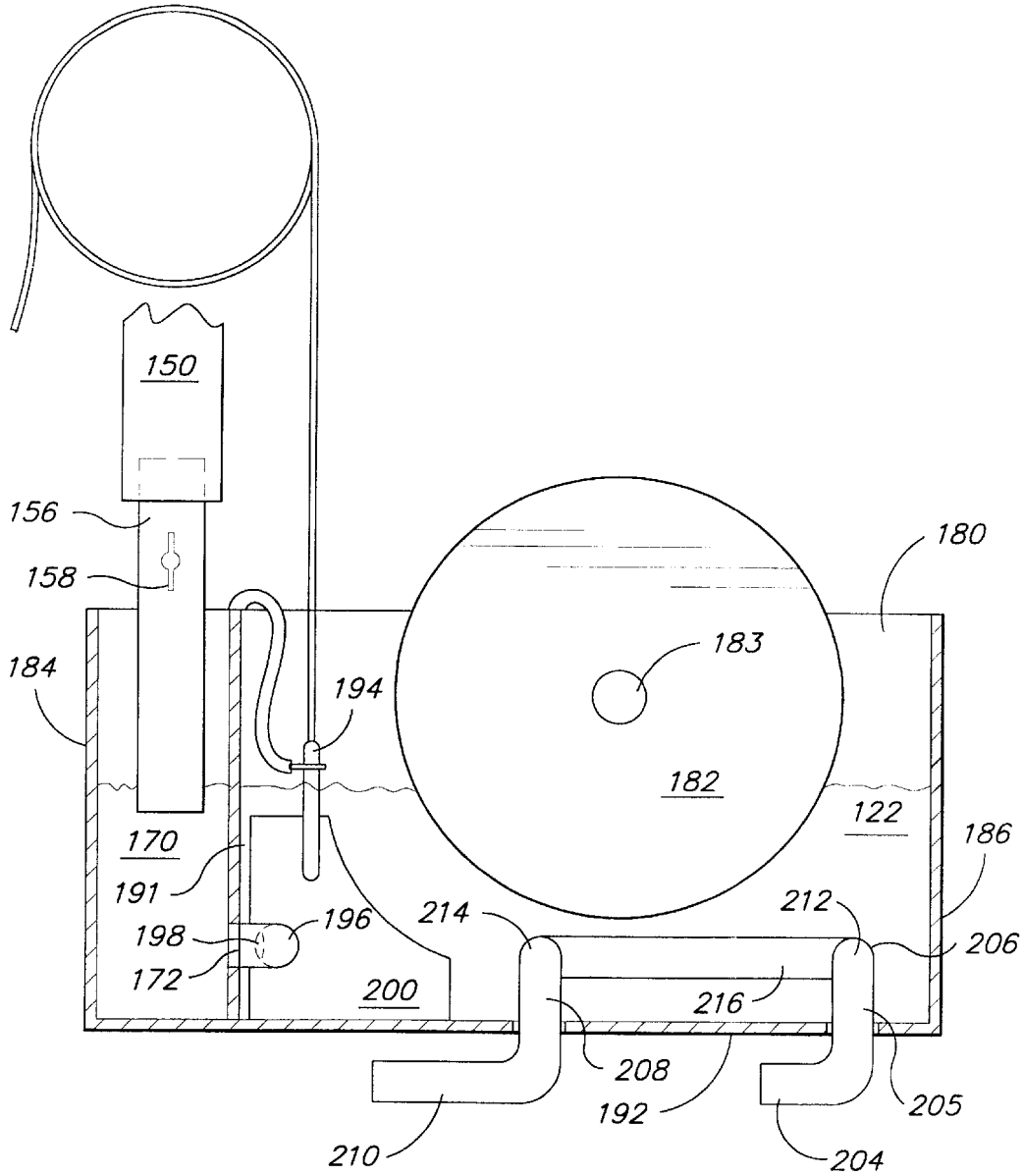
FIG. 5B is a sectional view of the temperature controlled solution pan of FIG. 5A taken in the vicinity of the near end wall.

Referring to FIGS. 5, 5A, and 5B, dispersement tube 196 extends substantially the length of pan 180. Dispersement tube 196 is connected to supply pool 170 and includes a dispersement tube inlet 172 communicating with supply pool 170 through supply pool inner wall 191. Dispersement tube 196 has a plurality of dispersement tube openings 198 facing left wall 184 along the longitudinal axis of dispersement tube 196. Openings 198 increase in diameter from near wall 188 to far wall 190. There are approximately twenty openings 198, ranging from about one and one half to three millimeters in diameter. Compartment walls 200 are located along dispersement tube 196, forming dispersion compartments 201, each containing front and rear openings so as to aid in distribution of fluid 122 from dispersement tube openings 198 toward roller 182. Compartment walls 200 are preferably disposed substantially around and normal to said dispersement tube 196.

Referring to FIG. 4, and FIGS. 5, 5A, and 5B, solution pan coolant supply line 193 receives coolant from combined coolant supply line 112 and directs it through solution pan coolant supply temperature controlled valve 202, through solution pan coolant entry line 204 and entrance 205, and into solution pan coolant coil 206 having entrance header 212. Coolant fluid then flows through solution pan coolant crossover lines 216 to be collected in solution pan coolant exit header 214. The coolant removes heat from fluid 122 in solution pan 180 during this process. The coolant then flows through solution pan coolant exit 208 and into solution pan coolant return line 210 to combined coolant return line 148. The flow of coolant through valve 202 is controlled according to the temperature measured by solution pan temperature probe 194 located about halfway along the length of solution pan 180, thus controlling the fluid temperature within solution pan 180 for delivery to fountain solution roller 182 rotating on axles 132.

In operation, as roller 182 of printing unit 114 spins on its axles 183, fountain solution 122 is consumed from fountain solution pan 180. As this occurs, cool fountain solution is drawn by gravity from tank 120 through supply tube 150 into said fountain solution pan supply pool 170. From pool 170, fountain solution 122 flows through dispersement tube inlet 172, and then longitudinally through dispersement tube 196 toward far wall 190. As the fountain solution loses pressure within tube 196, it exits through the increasingly larger dispersement tube openings 198 within respective compartments 201 and travels toward coolant coil 206 for consumption by roller 182 rotating on roller axles 183.

It is to be understood that the present invention is not limited to the sole embodiments described above, but encompasses any and all embodiments within the scope of the following claims.

I claim:

1. A temperature controlled gravity feed fountain solution supply apparatus, comprising:

a) a fountain solution tank; and b) a supply tube extending from said tank to feed an insulated fountain solution pan below said tank, said pan comprising:

1) an elongated left wall, an elongated right wall opposite said left wall, a short near wall, a short far wall opposite said near wall, and a lowest surface connecting each said wall;

2) a supply pool, said pool receiving said lower tube, and receiving said fountain solution from said tank through said lower tube; and 3) an elongated dispersement tube extending substantially the length of said pan, said dispersement tube connected to said left wall and proximate to but not touching said lowest surface, said dispersement tube further comprising:

i) a dispersement tube inlet communicating with said supply pool;

ii) a plurality of dispersement tube openings facing said left wall along the longitudinal axis of said dispersement tube, said holes increasing in diameter from said near wall to said far wall; and iii) means for directing and cooling said fountain solution upon dispersement from said dispersement tube openings extending substantially the length of said dispersement tube.

2. The device according to claim 1, wherein said means for directing and cooling said fountain solution upon dispersement from said dispersement tube openings comprise a plurality of cooling fins comprising:

a) a first cooling fin extending from a top right edge of said dispersement tube toward said right wall and angling slightly away from said lowest surface at an acute angle from a plane parallel to said bottom surface of said pan, b) a wide second cooling fin extending from a bottom right edge of said dispersement tube toward said right wall and angling slightly toward said lowest surface at an acute angle from a plane parallel to said lowest surface of said pan; and c) a narrow third cooling fin extending from a base of said dispersement tube to said lowest surface of said pan.

3. The device according to claim 1, wherein said means for directing and cooling said fountain solution upon dispersement from said dispersement tube openings comprise:

a) compartment walls extending around and normal to said dispersement tube and forming compartments around each of said dispersement tube openings; and b) a cooling coil having coolant directed therethrough and located below said solution pan roller and parallel to the lowest surface said solution pan;

c) said compartment walls directing said fountain solution from each of said compartments toward said cooling coil.

4. The device according to claim 3 wherein said solution pan cooling coil comprises a) a coolant entrance in the vicinity of said near wall;

b) a coolant entrance header connected with said coolant entrance and extending along the length of said solution pan along one side of said pan;

c) a coolant exit header extending along the length of said other side of said pan and connected with a coolant exit in the vicinity of said near wall; and d) a plurality of coolant crossover lines extending between said coolant entrance header and said coolant exit header.

5. The device of claim 4, further comprising a) a solution pan coolant supply line;

b) a coolant temperature controlled valve in fluid communication with said coolant entrance; and c) a solution pan temperature probe located within said fountain solution pan;

d) said temperature controlled valve being responsive to said solution pan temperature probe to control coolant flow through said cooling coil and thereby maintain a desired fountain solution temperature within said solution pan.

6. The device of claim 5, further comprising solution tank cooling means, a coolant chiller, and a combined coolant supply line leading from said coolant chiller and supplying coolant to said solution pan coolant supply line and said fountain solution tank cooling means.

7. The device of claim 6, further comprising:

a) a solution pan coolant return line;

b) a fountain solution tank cooling means coolant return line; and c) a combined coolant return line in fluid connection with said solution pan coolant return line and said fountain solution tank cooling means coolant return line;

d) said combined coolant return line being disposed for returning coolant to said chiller.

8. The device of claim 7, wherein said coolant is a refrigerant and said chiller provides said coolant to said combined coolant supply line.

9. The device of claim 7, wherein said coolant is chilled water, and said chiller comprises a refrigeration unit and refrigerant coils for cooling said chilled water and a pump for pumping said chilled water coolant from said chiller to said solution tank cooling means and said solution pan cooling coil.

10. The device of claim 3, wherein said fountain solution tank is generally rectangular and having a bottom surface, an upper surface, and four sides, and a plurality of cooling coils disposed therein, wherein said cooling coils are supported by supports located on said fountain solution tank bottom surface, and are otherwise self-supporting, said coils being disposed in a generally rectangular configuration, generally conforming to said tank sides, and wherein said fountain solution tank bottom surface has a plurality of apertures therethrough, located in a portion of said solution tank bottom surface and leading to a solution tank lower solution collector, thus functioning as a baffle therebetween, which solution collector, in turn, feeds said supply tube.

11. A temperature controlled gravity feed fountain solution supply apparatus, comprising:

a) an insulated fountain solution tank, comprising:
   1) a bottom surface, a top surface, a plurality of sides, and an outlet;
   2) a radiator style cap on said top surface;
   3) a cooling apparatus, comprising:
      i) a plurality of cooling coils arranged in layers;
      ii) a perforated heat-conducting cooling plate attached to a bottom edge of each of said coils; and
      iii) a set of cooling plate supports, supporting said cooling plates upon said bottom surface of said tank;

b) a thermostat connected to a refrigeration unit; and c) a first temperature probe connecting an interior of said tank to said thermostat; and d) an insulated supply tube feeding fountain solution from said tank to an insulated fountain solution pan below said tank;

e) said solution tank bottom surface defining a plurality of apertures therethrough located at one end thereof, and leading to said solution tank outlet;

whereby refrigerant or chilled water is supplied to said coolant coils, and said thermostat controls flow of said refrigerant or chilled water so as to maintain a desired fountain solution temperature responsive to said first temperature probe for delivery to said fountain solution pan.

12. A temperature controlled gravity feed fountain solution supply apparatus, comprising:

a) an air tight, insulated fountain solution tank, said tank comprising:
   1) a bottom surface, a top surface, a plurality of sides, and an outlet;
   2) a radiator style cap on said top surface; and
   3) a cooling apparatus, comprising:
      i) a plurality of cooling coils arranged in layers, each layer being supported upon said bottom surface;
      ii) a perforated heat-conducting cooling plate attached to the bottom of each of said coils; and
      iii) a set of cooling plate supports supporting said cooling plates upon said bottom surface of said tank;

4) a thermostat connected to a control valve for controlling the flow of coolant to said solution tank cooling apparatus;

5) a first temperature probe connecting an interior of said tank to said thermostat; and 6) an insulated supply tube, comprising:

i) an upper tube extending from said outlet, proximate said first temperature probe;

ii) a lower tube having a shutoff valve; and iii) a middle tube connecting said upper tube to said lower tube; and b) an insulated fountain solution pan below said tank, said pan comprising:

1) an elongated left wall, an elongated right wall opposite said left wall, a short near wall, a short far wall opposite said near wall, and a lowest surfaces connecting each said wall;

2) a supply pool, said pool receiving said lower tube, and receiving said fountain solution from said tank through said lower tube; and 3) an elongated dispersement tube extending substantially the length of said pan, said dispersement tube connected to said left wall and proximate to but not touching said lowest surface, said dispersement tube further comprising:

i) a dispersement tube inlet communicating with said supply pool;

ii) a plurality of dispersement tube openings facing said left wall along the longitudinal axis of said dispersement tube, said holes increasing in diameter from said near wall to said far wall; and iii) means for directing and cooling said fountain solution upon dispersement from said dispersement tube openings extending substantially the length of said dispersement tube.

13. The device according to claim 12, wherein said means for directing and cooling said fountain solution upon dispersement from said dispersement tube openings comprise a plurality of cooling fins comprising:

a) a first cooling fin extending from a top right edge of said dispersement tube toward said right wall and angling slightly away from said lowest surface at an acute angle from a plane parallel to said bottom surface of said pan, b) a wide second cooling fin extending from a bottom right edge of said dispersement tube toward said right wall, and angling slightly toward said lowest surface at an acute, angle from a plane parallel to said lowest surface of said pan; and c) a narrow third cooling fin extending from a base of said dispersement tube to said lowest surface of said pan.

14. The device according to claim 12, wherein said means for directing and cooling said fountain solution upon dispersement from said dispersement tube openings comprise:

a) compartment walls extending around and normal to said dispersement tube and forming compartments around each of said dispersement tube openings; and b) a cooling coil having coolant directed therethrough and located below said solution pan roller and parallel to the lowest surface of said solution pan;

c) said compartment walls directing said fountain solution from each of said compartments toward said cooling coil.

15. The device according to claim 14 wherein said solution pan cooling coil comprises:

a) a coolant entrance in the vicinity of said near wall;

b) a coolant entrance header connected with said coolant entrance and substantially extending along the length of said solution pan along one side of said pan;

c) a coolant exit header extending along the length of said other side of said pan and connected with a coolant entrance in the vicinity of said near wall; and d) a plurality of coolant crossover lines extending between said coolant entrance header and said coolant exit header.

16. The device of claim 15, further comprising:

a) a solution pan coolant supply line;

b) a coolant temperature control valve in fluid communication with said coolant entrance; and c) a solution pan temperature probe located within said fountain solution pan;

d) said temperature controlled valve being responsive to said solution pan temperature probe to control coolant flow through said cooling coil and thereby maintain a desired fountain solution temperature within said solution pan.

17. The device of claim 16, further comprising a combined coolant supply line leading from a coolant chiller and supplying coolant to said solution pan coolant supply line and said fountain solution tank cooling apparatus.

18. The device of claim 17, further comprising:

a) a solution pan coolant return line b) a fountain solution tank cooling means coolant return line; and c) a combined coolant return line in fluid connection with said solution pan coolant return line and said fountain solution tank cooling apparatus coolant return line;

d) said combined coolant return line returning coolant to said chiller.

19. The device of claim 18, wherein said coolant is a refrigerant and said chiller provides said coolant to said combined coolant supply line.

20. The device of claim 18, wherein said coolant is chiller water and said chiller comprises a refrigeration unit and refrigerant coils for cooling said chilled water, and a pump for pumping said chilled water coolant from said chiller to said solution tank cooling means and said solution pan cooling coil.

* * * * *